US008540482B2

(12) United States Patent
Malmborg et al.

(10) Patent No.: US 8,540,482 B2
(45) Date of Patent: Sep. 24, 2013

(54) ROTOR ASSEMBLY FOR GAS TURBINE ENGINE

(75) Inventors: Eric W. Malmborg, Amston, CT (US); Matthew E. Bintz, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 469 days.

(21) Appl. No.: 12/794,918

(22) Filed: Jun. 7, 2010

(65) Prior Publication Data

US 2011/0299992 A1 Dec. 8, 2011

(51) Int. Cl.
*F01D 1/24* (2006.01)

(52) U.S. Cl.
USPC ..... 415/199.1; 416/198 A

(58) Field of Classification Search
USPC ..... 415/198.1, 199.4, 199.5; 416/198 R, 416/198 A, 214 A, 244 A
See application file for complete search history.

(56) References Cited

U.S. PATENT DOCUMENTS

| | | | | |
|---|---|---|---|---|
| 2,640,679 | A * | 6/1953 | Wheatley et al. | 415/209.4 |
| 2,654,565 | A * | 10/1953 | Feilden | 416/201 R |
| 3,515,501 | A | 6/1970 | Palfreyman et al. | |
| 3,546,882 | A | 12/1970 | Berkey | |
| 3,647,313 | A | 3/1972 | Koff | |
| 3,807,895 | A * | 4/1974 | McMurtry | 415/199.5 |
| 4,291,531 | A | 9/1981 | Campbell | |
| 4,581,300 | A | 4/1986 | Hoppin, III et al. | |
| 4,645,416 | A | 2/1987 | Weiner | |
| 4,648,241 | A | 3/1987 | Putman et al. | |
| 4,719,747 | A | 1/1988 | Willkop et al. | |
| 4,746,579 | A | 5/1988 | Yannich et al. | |
| 4,793,772 | A | 12/1988 | Zaehring et al. | |
| 4,808,073 | A | 2/1989 | Zaehring et al. | |
| 4,844,694 | A | 7/1989 | Naudet | |
| H777 | H | 5/1990 | Natarajan | |
| 4,920,741 | A | 5/1990 | Liebl | |
| 4,961,309 | A | 10/1990 | Liebl | |
| 5,108,261 | A | 4/1992 | Ress, Jr. et al. | |
| 5,232,339 | A | 8/1993 | Plemmons et al. | |
| 5,271,711 | A | 12/1993 | McGreehan et al. | |
| 5,297,386 | A | 3/1994 | Kervistin | |
| 5,308,225 | A | 5/1994 | Koff et al. | |
| 5,310,319 | A | 5/1994 | Grant et al. | |
| 5,350,278 | A | 9/1994 | Burge | |
| 5,360,318 | A | 11/1994 | Siga et al. | |
| 5,400,505 | A | 3/1995 | Wei et al. | |
| 5,417,501 | A | 5/1995 | Hyde et al. | |
| 5,465,780 | A | 11/1995 | Muntner et al. | |
| 5,564,896 | A | 10/1996 | Beeck et al. | |
| 5,660,526 | A | 8/1997 | Ress, Jr. | |
| 5,685,158 | A | 11/1997 | Lenahan et al. | |

(Continued)

FOREIGN PATENT DOCUMENTS

| | | |
|---|---|---|
| DE | 8605507 | 5/1987 |
| DE | 10163951 C1 | 12/2002 |

*Primary Examiner* — Nathaniel Wiehe
*Assistant Examiner* — Woody A Lee, Jr.
(74) *Attorney, Agent, or Firm* — Carlson, Gaskey & Olds, P.C.

(57) ABSTRACT

A rotor assembly for a gas turbine engine includes a rotor airfoil and a first rotor disk. The rotor airfoil extends along a radial axis. The first rotor disk includes an outer rim, a bore and a web extending between the outer rim and the bore. The first rotor disk is axially offset from the radial axis of the rotor airfoil.

19 Claims, 6 Drawing Sheets

(56) References Cited

U.S. PATENT DOCUMENTS

| | | | |
|---|---|---|---|
| 5,700,130 | A | 12/1997 | Barbot et al. |
| 5,733,050 | A | 3/1998 | Diepolder et al. |
| 5,755,556 | A | 5/1998 | Hultgren et al. |
| 5,822,841 | A | 10/1998 | Bales et al. |
| 5,961,287 | A | 10/1999 | Cairo |
| 6,009,701 | A | 1/2000 | Freeman et al. |
| 6,082,959 | A | 7/2000 | Van Duyn |
| 6,240,719 | B1 | 6/2001 | Vondrell et al. |
| 6,267,553 | B1 | 7/2001 | Burge |
| 6,361,277 | B1 | 3/2002 | Bulman et al. |
| 6,468,032 | B2 | 10/2002 | Patel |
| 6,478,545 | B2 | 11/2002 | Crall et al. |
| 6,969,238 | B2 | 11/2005 | Groh et al. |
| 7,011,490 | B2 | 3/2006 | Albrecht et al. |
| 7,367,775 | B2 | 5/2008 | Borufka et al. |
| 7,600,965 | B2 | 10/2009 | Seitz |
| 7,665,960 | B2 | 2/2010 | Shi et al. |
| 2004/0013521 | A1 | 1/2004 | Yamada |
| 2005/0232774 | A1* | 10/2005 | Suciu et al. ..... 416/198 A |
| 2007/0022738 | A1* | 2/2007 | Norris et al. ..... 60/226.1 |
| 2009/0290974 | A1 | 11/2009 | Bayere et al. |

* cited by examiner

ROTOR ASSEMBLY FOR GAS TURBINE ENGINE

BACKGROUND

This application relates generally to a gas turbine engine, and more particularly to a rotor assembly for a gas turbine engine.

Gas turbine engines include rotor assemblies having a plurality of rotating airfoils or blades. The rotor assemblies, especially in the high pressure compressor section, are subjected to a large strain range (e.g., creep-fatigue mechanism) during operation. The large strain range is induced during the engine flight cycle and is at least partially attributable to the extreme temperature differences between the relatively hot primary flowpath airflow that is communicated through the compressor section and the relatively cool compressor rotor assembly components. The large strain range acting on the rotor assembly can result in a relatively low fatigue life of such components.

Attempts to improve component fatigue life of the rotor assembly have included extracting primary flowpath air to cool the inner diameters of the compressor rotor assembly. However, this solution can compromise compressor efficiency.

SUMMARY

A rotor assembly for a gas turbine engine includes a rotor airfoil and a first rotor disk. The rotor airfoil extends along a radial axis. The first rotor disk includes an outer rim, a bore and a web extending between the outer rim and the bore. The first rotor disk is axially offset from the radial axis of the rotor airfoil.

In another exemplary embodiment, a gas turbine engine includes a section having alternating rows of rotating rotor airfoils and static stator vanes. A rotor assembly includes a first rotor disk and a second rotor disk. The first rotor disk and the second rotor disk each include a plurality of rotor airfoils. Each of the rotor airfoils are integrally formed with a bladed ring that is radially trapped between the first rotor disk and the second rotor disk.

In another exemplary embodiment, a method for providing a rotor assembly for a gas turbine engine includes positioning a rotor disk of the rotor assembly at a position that is axially offset relative to a radial axis of a rotor airfoil of the rotor assembly.

The various features and advantages of this disclosure will become apparent to those skilled in the art from the following detailed description. The drawings that accompany the detailed description can be briefly described as follows.

DETAILED DESCRIPTION

Figure 1:
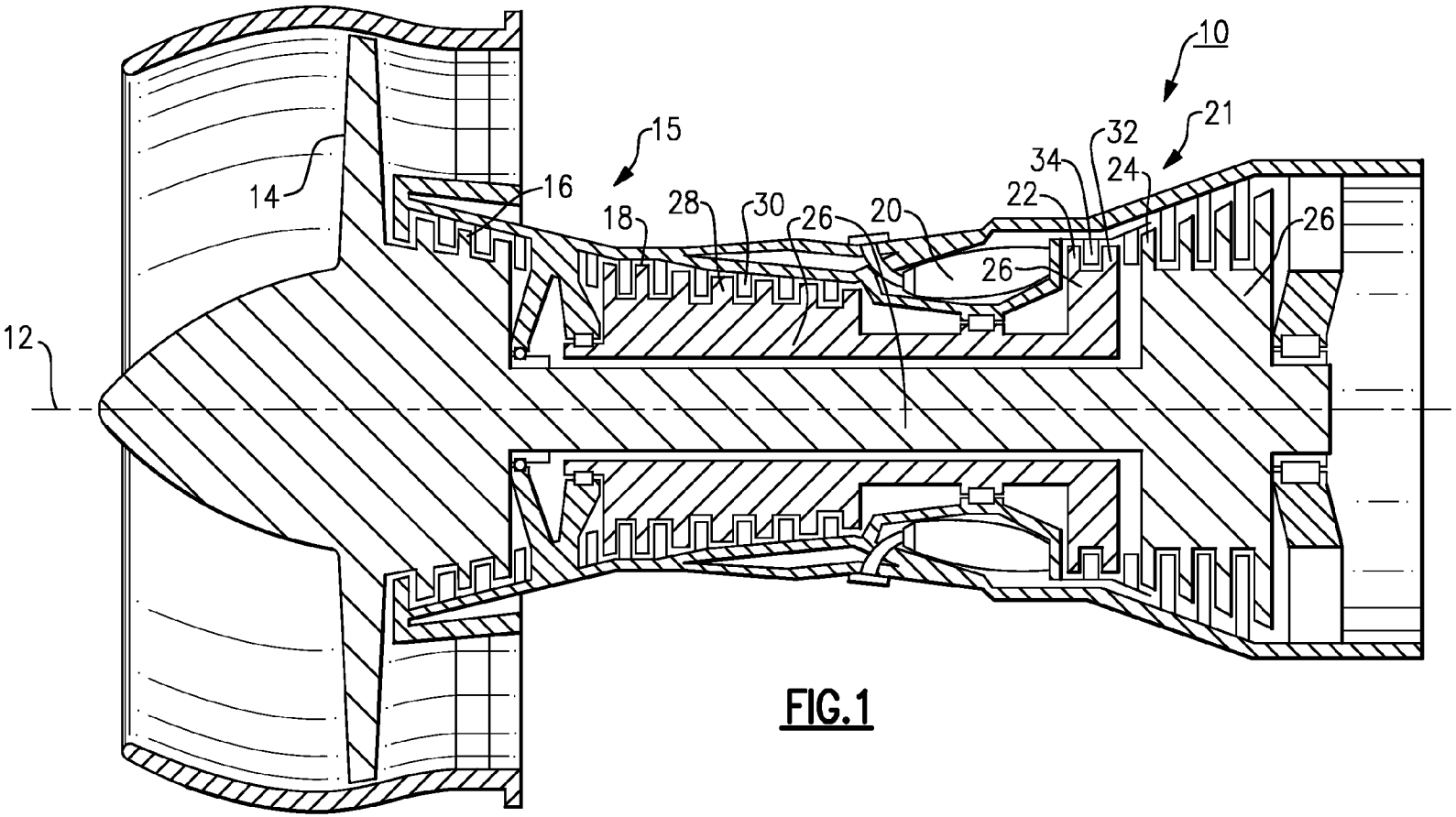
FIG. 1 illustrates a simplified cross-sectional view of a standard gas turbine engine.

FIG. 1 shows a gas turbine engine 10, such as a turbofan gas turbine engine, that is circumferentially disposed about an engine centerline (or axial centerline axis) 12. The gas turbine engine 10 includes a fan section 14, a compressor section 15 having a low pressure compressor 16 and a high pressure compressor 18, a combustor 20, and a turbine section 21 including a high pressure turbine 22 and a low pressure turbine 24. This application can also extend to engines without a fan, and with more or fewer sections.

As is known, air is compressed in the low pressure compressor 16 and the high pressure compressor 18, is mixed with fuel and burned in the combustor 20, and is expanded in the high pressure turbine 22 and the low pressure turbine 24. Rotor assemblies 26 rotate in response to the expansion, driving the low pressure and high pressure compressors 16, 18 and the fan section 14. The low and high pressure compressors 16, 18 include alternating rows of rotating compressor rotor airfoils or blades 28 and static stator vanes 30. The high and low pressure turbines 22, 24 include alternating rows of rotating turbine rotor airfoils or blades 32 and static stator vanes 34.

It should be understood that this view is included simply to provide a basic understanding of the sections of a gas turbine engine 10 and not to limit the disclosure. This disclosure extends to all types of gas turbine engines 10 for all types of applications.

Figure 2:
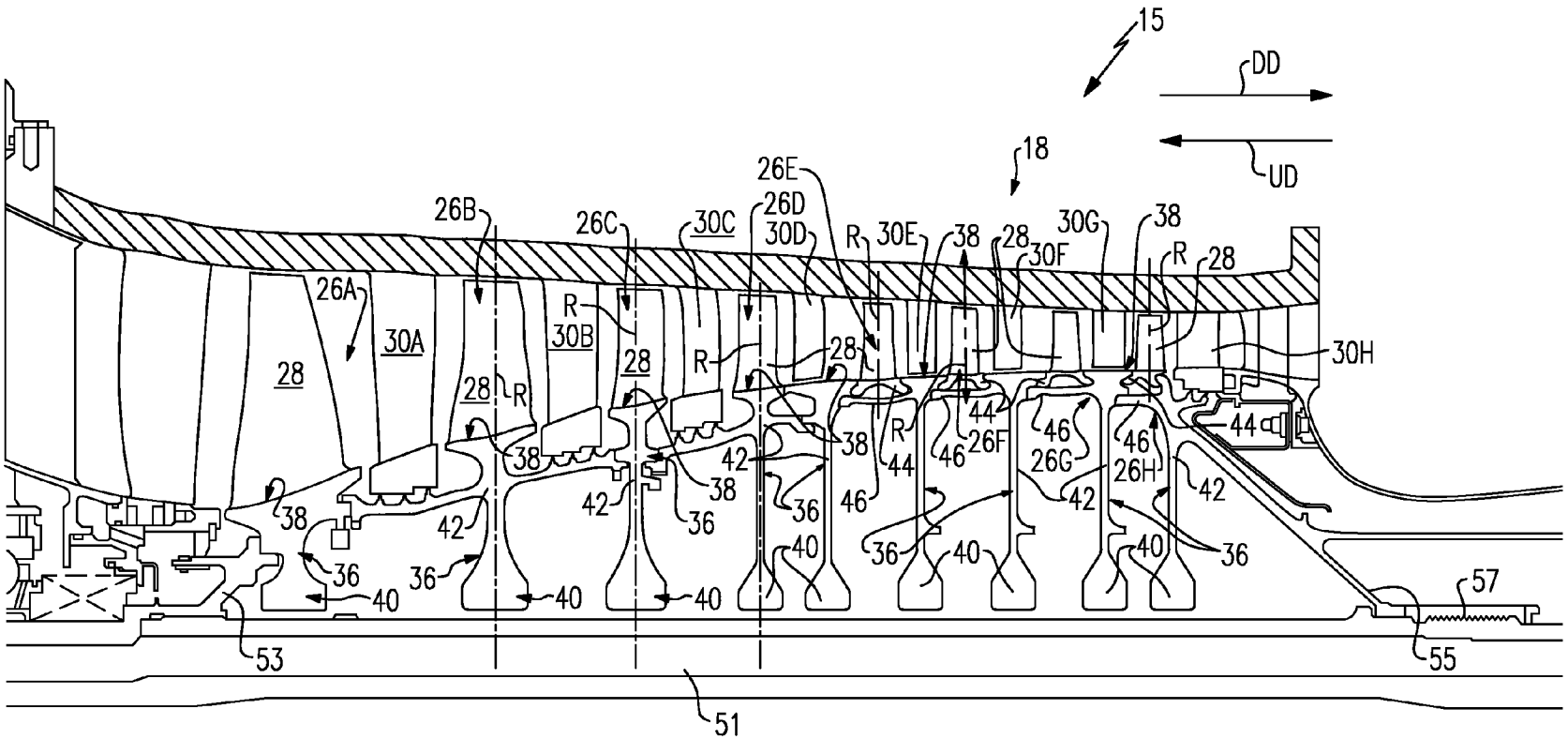
FIG. 2 illustrates a cross-sectional view of a portion of the gas turbine engine.

FIG. 2 shows a portion of the compressor section 15 of the gas turbine engine 10. In this example, the portion shown is the high pressure compressor 18 of the gas turbine engine 10. However, this disclosure is not limited to the high pressure compressor 18, and could extend to other sections of the gas turbine engine 10.

The illustrated compressor section 15 includes multiples stages of alternating rows of rotor assemblies 26A-26H and stator vanes 30A-30H. In this example, eight stages are shown, although the compressor section 15 could include more or less stages. The stator vanes 30A-30H extend between each rotor assembly 26. Each rotor assembly 26 includes a rotor airfoil 28 and a rotor disk 36. The rotor disks 36 include an outer rim 38, a bore 40, and a web 42 that extends between the outer rim 38 and the bore 40.

At least a portion of the rotor assemblies 26 include an axially offset rotor disk 36. That is, the rotor disk 36 is axially offset (See rotor assembly 26F) from a radial axis R of the rotor airfoil 28. It should be understood that the axial offset of the illustrated rotor disks 36 is not shown to the scale it would be in practice. Instead, the axial offset is shown enlarged to better illustrate the positioning of the rotor disks 36 relative to the radial axis R of the rotor airfoils 28. The actual distance of the axial offset will vary depending upon a number of factors including but not limited to airfoil positioning, the number of stages in compressor section 15, bleed location requirements, the axial length of the compressor section 15 and the spacing requirements between adjacent rotor disks 36.

In this example, the rear stages of the high pressure compressor 18 include rotor assemblies 26E-26H having axially offset rotor disks 36. However, each rotor assembly 26A-26H could include an axially offset rotor disk 36, or the axial displacement could be applied to only a portion of the stages (such as depicted in FIG. 2). The stages that do not include an axially offset rotor disk 36 (in this example, rotor assemblies 26A-26D) can include standard axial attachments in which the rotor disks 36 are substantially in-line with the radial axis R of the rotor airfoils 28.

A tie shaft 51 is connected to the rotor assemblies 26A-26H. The tie shaft 51 can be preloaded to maintain tension on the plurality of rotor assemblies 26A-26H. The tie shaft 51 extends between a forward hub 53 and an aft hub 55. In this example, the tie shaft 51 is threaded through the forward hub 53 and is snapped into the rotor disk 36 of the rotor assembly 26H. Once connected between the forward hub 53 and the aft hub 55, the preloaded tension on the tie shaft 51 is maintained with a nut 57.

Figure 3A:
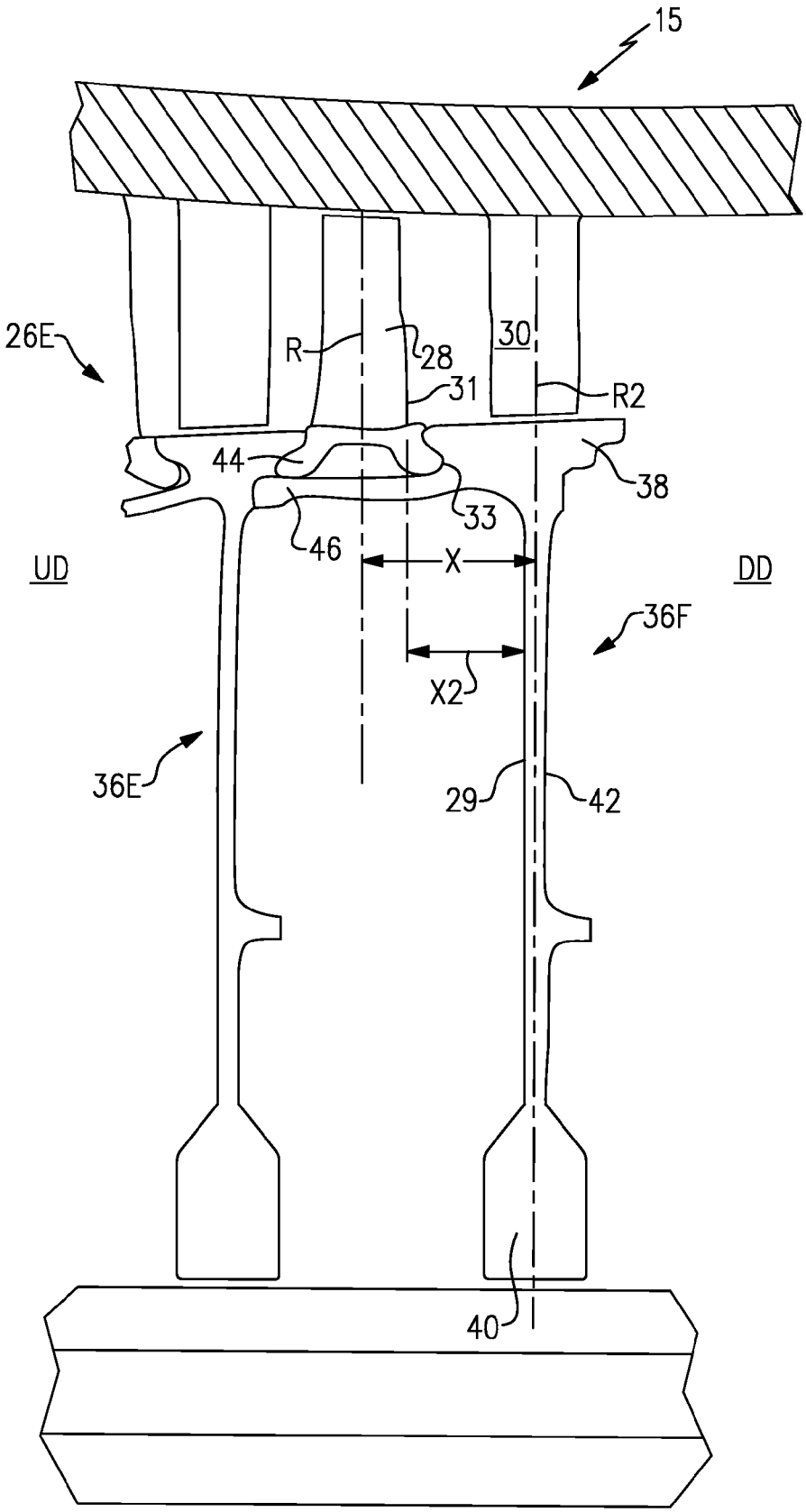
FIGS. 3A-3C illustrate additional cross-sectional views of a portion of the gas turbine engine.
Figure 3B:
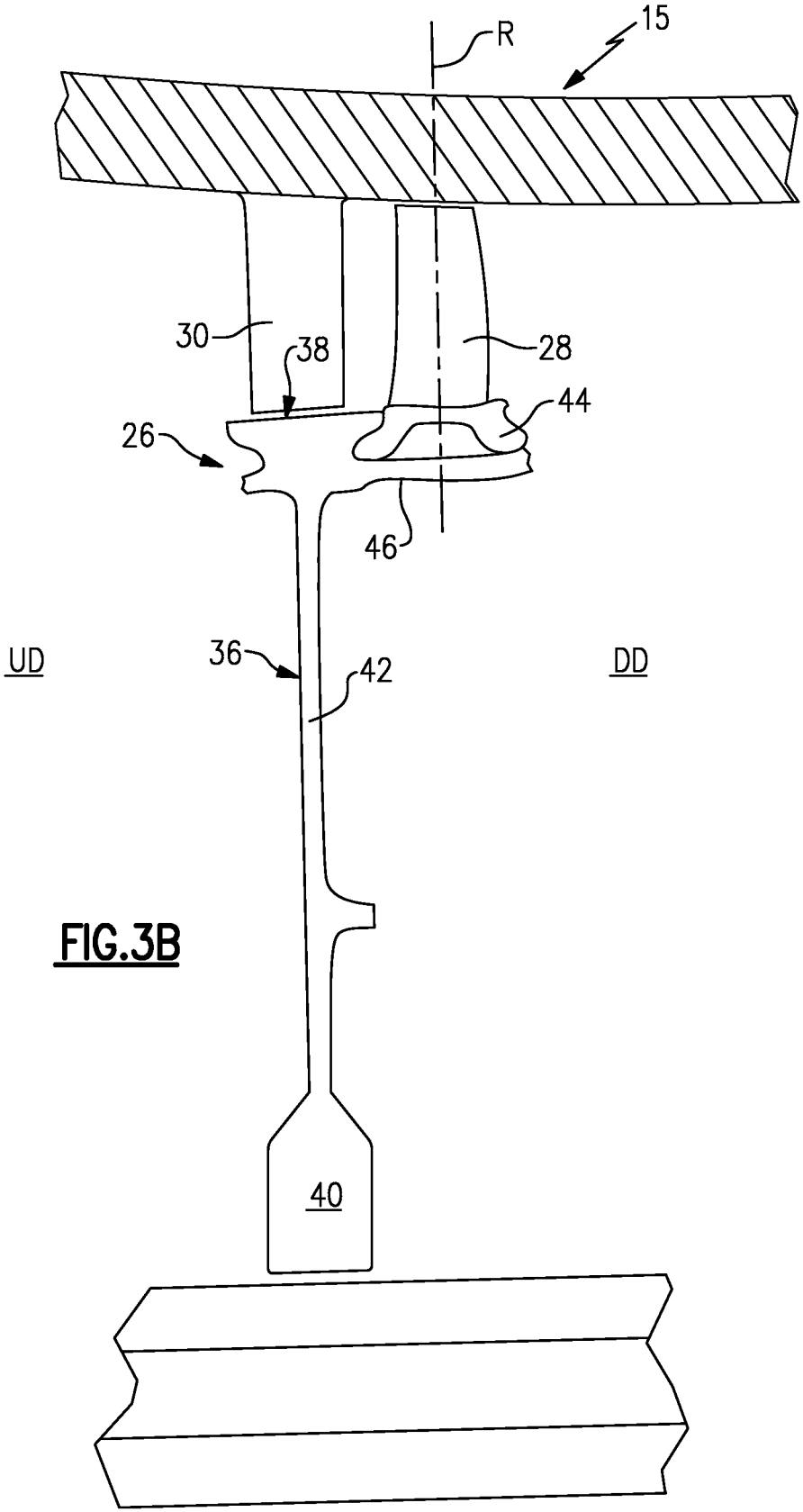

FIG. 3A illustrates a portion of the compressor section 15 that includes the rotor assembly 26F (and the rotor disk 36E of adjacent rotor assembly 26E). Each of the outer rim 38, the bore 40 and web 42 of the rotor disk 36F of rotor assembly 26F are axially offset from the radial axis R of the rotor airfoil 28. In this way, the outer rim 38, the bore 40 and the web 42 of the axially offset rotor disk 36F are each generally radially inward from the stator vane 30 and extend along a radial axis R2 of the stator vane 30. In one example, the outer rim 38, the bore 40 and the web 42 are generally coaxial with the stator vane 30. The outer rim 38 can also include a seal coating, such as Zirconium Oxide, to seal the interface between the stator vane 30 and the outer rim 38 to reduce the potential for damage to the stator vane 30. The rotor disks 36 are axially displaced in a downstream direction (DD) relative to the rotor airfoils 28, in this example. In another example embodiment, the rotor disks 36 are axially displaced in an upstream direction (UD) relative to the rotor airfoils 28 (see FIG. 3B).

Referring again to FIG. 3A, in this example the radial axis R2 that extends through the rotor disk 36 of rotor assembly 26F is axially offset from the radial axis R of the rotor airfoil 28 by a distance X. An axially outermost portion 29 of the web 42 is axially offset from an axially outermost portion 31 of the rotor airfoil 28 by a distance X2 such that no portion of the web 42 is positioned directly radially inwardly from the rotor airfoil 28. In other words, the entire web 42 is fully offset from the radial axis R of the rotor airfoil 28 in a direction away from the rotor airfoil 28.

The portion of the rotor assemblies 26 that include axially offset rotor disks 36 further include a bladed ring 44 (e.g., bling). In the example embodiment, the bladed rings 44 and the rotor airfoils 28 are integrally formed as a single, continuous piece with no mechanical attachments. That is, the rotor airfoils 28 are detached from a traditional integrally bladed rotor (IBR) and are instead formed as a single, continuous piece with the bladed rings 44. The airfoils 28 extend radially outwardly from the bladed rings 44. In this example, the axially outermost portion 29 of the web 42 is axially offset from an axially outermost portion 33 of the bladed ring 44.

The bladed rings 44 can include a tangential style attachment which conforms to the profile of adjacent portions of the rotor disks 36 to radially trap the bladed rings 44, and therefore, the rotor airfoils 28, in the radial direction. In one example, the bladed rings 44 are sandwiched between the outer rims 38 of adjacent rotor disks 36. Here, the bladed ring 44 is radially trapped between the rotors disk 36E (e.g., a first rotor disk) and rotor disk 36F (e.g., a second rotor disk) of rotor assemblies 26E, 26F. The bladed rings 44 can also be trapped between the webs 42 of adjacent rotor disks 36. Friction forces between the bladed ring 44 and adjacent rotor disks 36 minimize any circumferential movement of the bladed ring 44 relative to the rotor disk 36. The bladed rings 44 enable the airfoils 28 to be decoupled from the rotor disks 36, thereby improving part life by relocating the notch feature (e.g., transition area of leading end and trailing end fillets of the airfoils 28 and the rotor disks 36) off of the rotor disks 36.

The axially offset rotor disks 36 further include a spacer 46 that extends from the rotor disk 36. In this example, a catenary spacer 46 extends from the web 42 of the rotor disk 36. In another example, the spacer 46 is a cylindrical or conical spacer. The spacers 46 are positioned radially inwardly from the bladed rings 44 to provide radial load support for the rotor airfoils 28. The spacers 46 are integrally formed with the rotor disk 36. In one example embodiment, the spacers 46 extend in the upstream direction UD from the rotor disks 36. In another example, the spacers 46 extend in the downstream direction DD from the rotor disks 36 (See FIG. 3B).

Figure 3C:
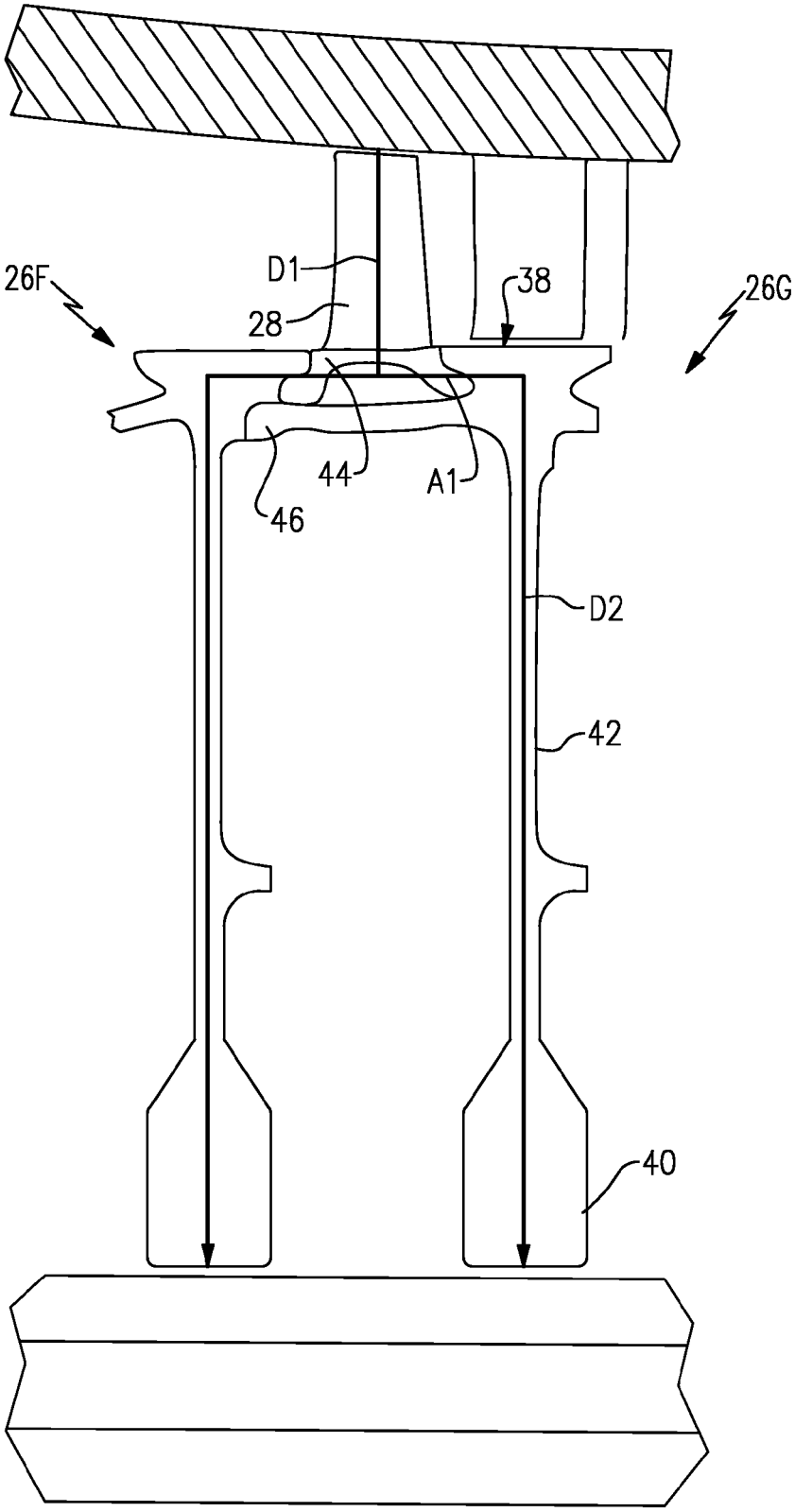

Referring to FIG. 3C, the axial displacement of the outer rims 38, bores 40 and webs 42 of the rotor disks 36 relative to the rotor airfoils 28 alters the fundamental load path of the airfoil radial pull (RP) and creates a non-direct path for the radial pull RP. For example, as best illustrated by rotor assembly 26G, the modified load path runs in the radial direction D1 along the span of the rotor airfoil 28, then axially in a direction A1 aft of the rotor airfoil 28, and then radially along the rotor disk 36 in the direction D2. In other words, the radial pull of each rotor airfoil 28 runs axially along the airfoil 28 prior to moving down the web 42 and into the bore 40 of the rotor disk 36. Accordingly, the modified load path minimizes the strain range that each rotor assembly 26 is subjected to during gas turbine engine 10 operation and otherwise enhances rotor response without the need to extract primary flowpath airflow to cool each rotor assembly 26 by effectively decoupling the rotor airfoils 28 from the rotor disks 36.

Figure 4:
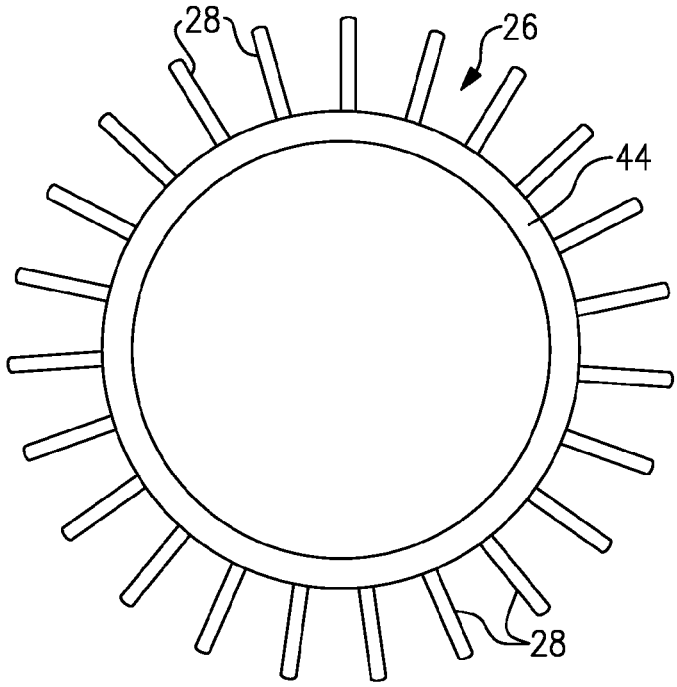
FIG. 4 illustrates an example rotor assembly that includes a bladed ring.

FIG. 4 illustrates an example rotor assembly 26 including a bladed ring 44 that is represented as a full hoop ring. In this example embodiment, the bladed ring 44 extends circumferentially over 360° to form the full hoop ring. A plurality of rotor airfoils 28 are integrally formed with the full hoop bladed ring 44 as a single, continuous piece with no mechanical attachments.

Figure 5:
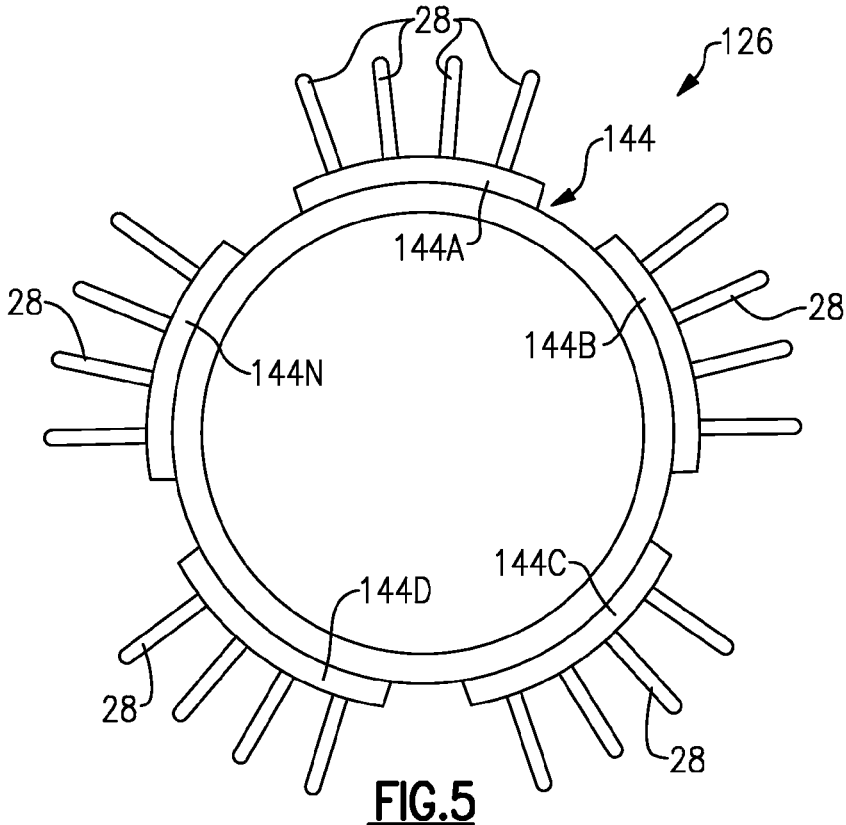
FIG. 5 illustrates another example rotor assembly including a bladed ring.

FIG. 5 illustrates another example rotor assembly 126. The rotor assembly 126 includes a segmented bladed ring 144. Rather than extending in a full hoop, the segmented bladed ring 144 is apportioned into a plurality of separate components 144A-144N that provide greater compliance to the rotor assembly 126. The actual number of segmentations will vary depending upon design specific parameters. A plurality of rotor airfoils 28 are integrally formed with each segmented portion of the segmented bladed ring 144. Any number of clusters of rotor airfoils 28 can be formed onto each component 144A-144N of the segmented bladed ring 144, including a single airfoil 28 per component 144A-144N.

The foregoing description shall be interpreted as illustrative and not in any limiting sense. A worker of ordinary skill in the art would understand that certain modifications would come within the scope of this disclosure. For these reasons, the following claims should be studied to determine the true scope and content of this disclosure.

What is claimed is:

1. A rotor assembly for a gas turbine engine, comprising:

a bladed ring defining a radial axis and having a plurality of separate components that are spaced apart from one another;

a rotor airfoil that extends from each of said plurality of separate components along said radial axis;

a first rotor disk radially supporting said rotor airfoil and having an outer rim, a bore and a web extending between said outer rim and said bore, wherein said first rotor disk is axially offset from said radial axis of said rotor airfoil; and a second rotor disk radially supporting another rotor airfoil and having an outer rim, a bore and a web extending between said outer rim and said bore, wherein said second rotor disk is axially in-line with a radial axis of said another rotor airfoil.

2. The assembly as recited in claim 1, wherein said rotor airfoil is integrally formed with said bladed ring.

3. The assembly as recited in claim 1, wherein said bladed ring is a full hoop bladed ring.

4. The assembly as recited in claim 1, wherein said bladed ring is segmented.

5. The assembly as recited in claim 1, wherein said rotor airfoil and said bladed ring are a single, continuous structure with no mechanical attachments.

6. The assembly as recited in claim 1, comprising a third rotor disk, wherein said bladed ring is radially trapped between said first rotor disk and said third rotor disk.

7. The assembly as recited in claim 6, comprising a spacer that extends between said first rotor disk and said third rotor disk.

8. The assembly as recited in claim 7, wherein said spacer is positioned radially inwardly from said rotor airfoil.

9. The assembly as recited in claim 1, wherein said first rotor disk is axially offset in an upstream direction from said radial axis of said rotor airfoil.

10. The assembly as recited in claim 1, wherein said first rotor disk is axially offset in a downstream direction from said radial axis of said rotor airfoil.

11. The assembly as recited in claim 1, wherein an axially outermost portion of said web is fully axially offset from an axially outermost portion of said rotor airfoil in a direction away from said rotor airfoil.

12. A gas turbine engine, comprising:

a section including alternating rows of rotating rotor airfoils and static stator vanes;

wherein said section includes a first rotor assembly having a first rotor disk and a second rotor assembly having a second rotor disk, and each of said first rotor disk and said second rotor disk radially supporting a plurality of said rotor airfoils, wherein said first rotor disk is axially offset from a first radial axis of said plurality of rotor airfoils of said first rotor disk and said second rotor disk is axially in-line with a second radial axis of said plurality of rotor airfoils of said second rotor disk.

13. The gas turbine engine as recited in claim 12, wherein said section is a compressor section and includes a plurality of rotor assemblies, and said rotor assemblies are connected with a tie shaft.

14. The gas turbine engine as recited in claim 12, wherein said first rotor disk is fully axially offset from said plurality of said rotor airfoils.

15. The gas turbine engine as recited in claim 12, wherein each of said first rotor disk and said second rotor disk includes an outer rim, a bore and a web that extends between said outer rim and said bore, wherein said outer rim, said bore and said web are radially inward from one of said static stator vanes.

16. A method for providing a rotor assembly for a gas turbine engine, comprising the steps of:

positioning a first rotor assembly such that a first rotor disk of the first rotor assembly is axially offset from a first radial axis of a first rotor airfoil of the first rotor assembly; and positioning a second rotor assembly such that a second rotor disk of the second rotor assembly is axially in-line with a second radial axis of a second rotor airfoil of the second rotor assembly, wherein the first rotor disk radially supports the first rotor airfoil and the second rotor disk radially supports the second rotor airfoil.

17. The method as recited in claim 16, wherein the first rotor disk is axially offset in an upstream direction relative to the first radial axis of the first rotor airfoil.

18. The method as recited in claim 16, wherein the first rotor disk is axially offset in a downstream direction relative to the first radial axis of the first rotor blade.

19. The method as recited in claim 16, wherein said first rotor disk includes an outer rim, a bore and a web extending between said outer rim and said bore, and including the step of:

positioning each of the outer rim, the bore and the web at a position that is fully axially offset from the first radial axis of the first rotor airfoil.

* * * * *